US006718999B2

(12) United States Patent
Elsey

(10) Patent No.: US 6,718,999 B2
(45) Date of Patent: Apr. 13, 2004

(54) COLD WATER SUPPLY SYSTEMS

(76) Inventor: Stephen John Elsey, 29 Ladysmith Avenue, Brightlingsea, Essex C07 0JD (GB)

( * ) Notice: Subject to any disclaimer, the term of this patent is extended or adjusted under 35 U.S.C. 154(b) by 0 days.

(21) Appl. No.: 10/251,022

(22) Filed: Sep. 20, 2002

(65) Prior Publication Data

US 2003/0056825 A1 Mar. 27, 2003

(30) Foreign Application Priority Data

Sep. 21, 2001 (GB) ..... 0122743

(51) Int. Cl.[7] ..... E03C 1/00; E17D 1/16; F16L 55/04

(52) U.S. Cl. ..... 137/14; 137/357; 137/565.16; 137/565.34

(58) Field of Search ..... 137/14, 357, 565.16, 137/565.34

(56) References Cited

U.S. PATENT DOCUMENTS 407,830 A * 7/1889 Loretz ..... 137/565.34
1,482,376 A * 2/1924 Anderson ..... 137/565.16
3,095,893 A * 7/1963 Martin ..... 137/216
4,248,258 A * 2/1981 Devitt et al. ..... 137/124
5,901,744 A * 5/1999 Richards ..... 137/202
6,092,549 A * 7/2000 Eriksson ..... 137/357
6,568,426 B1 * 5/2003 Chapman ..... 137/565.34

* cited by examiner

*Primary Examiner*—A. Michael Chambers
(74) *Attorney, Agent, or Firm*—Renner, Kenner, Greive, Bobak, Taylor & Weber

(57) ABSTRACT

A cold water distribution system for a multi-storey building has a lower accumulator provided in the building on a lower floor thereof and an upper accumulator provided on an upper floor of the building. A water inlet pipe leads from an external mains water supply into the building and is connected to the lower accumulator through an inlet non-return valve. A riser leads from the lower accumulator to the upper accumulator and is provided with respective lower and upper non-return valves adjacent the outlet from the lower accumulator and the inlet to the upper accumulator. An electrically-driven pump is provided in the riser to pump water to the upper accumulator and a water distribution pipe is connected to the upper accumulator for supplying cold water to at least the upper floor of the building.

19 Claims, 1 Drawing Sheet

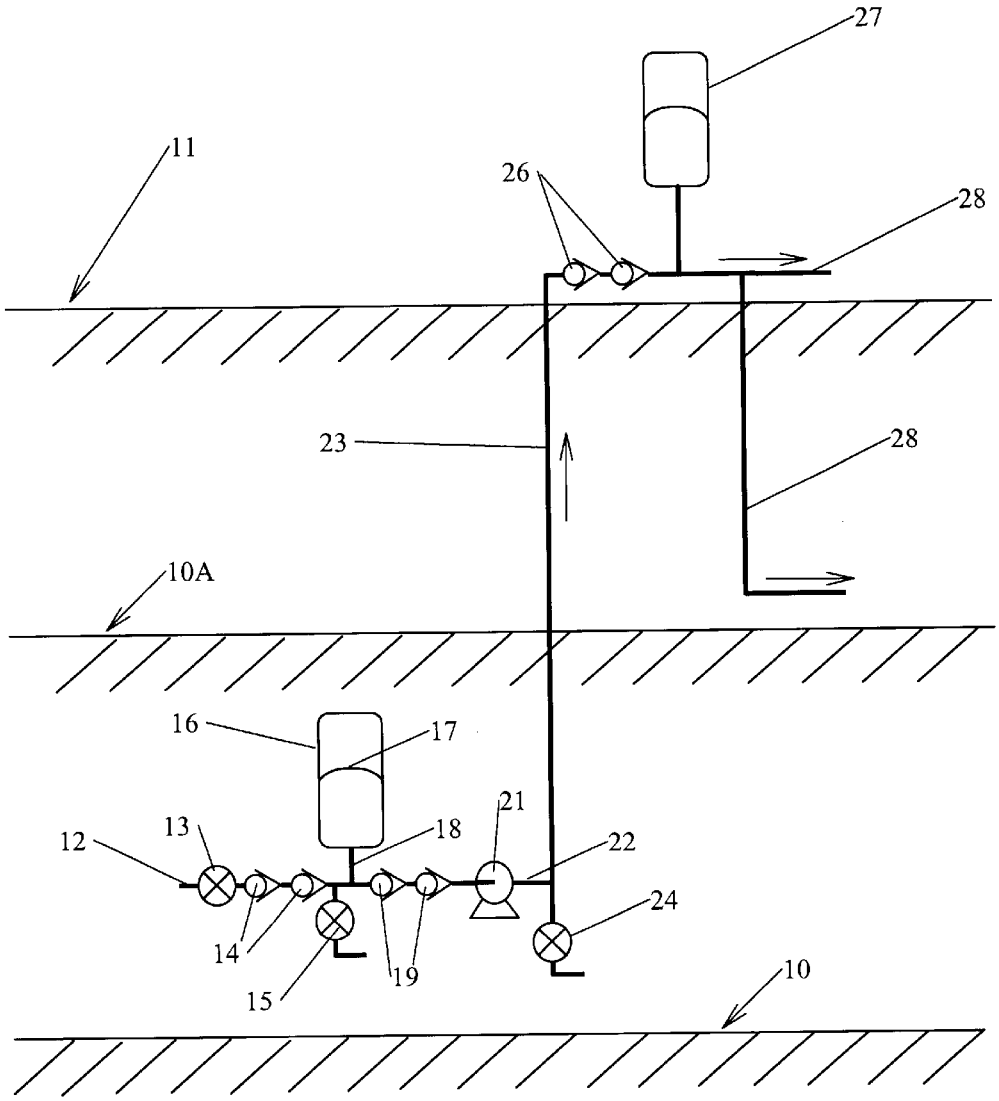
27
11
26
28
23
28
10A
16
17
21
12
13
18
22
24
14
19
15
10

COLD WATER SUPPLY SYSTEMS

BACKGROUND TO THE INVENTION a) Field of the Invention

This invention relates to a cold water supply system for a multi-storey building, and also to methods of supplying cold water around such a building.

b) Description of the Prior Art

Traditionally, in many countries it has been the practice when furnishing a building with a cold water supply system to provide a relatively large capacity tank in the roof space of the building and to feed cold water to that tank from the mains supply through a pipe fitted with a ball valve sensing the water level in the tank. The various cold water faucets around the building are connected by suitable distribution pipes to the tank, except for one faucet nearest the point at which the cold water supply enters the building, which faucet is directly connected to the incoming mains water pipe and so operates at mains water pressure.

An advantage of the above system is that it is possible to use a relatively small diameter incoming mains water pipe, along which the flow rate is relatively restricted—and which flow rate may well be lower than the maximum demand for example from a bath faucet. The pipe work connecting the tank to the faucets may be of a larger size than that of the incoming mains water pipe and so, for short periods, high flow rates may be achieved. Also, there is capacity in the event that the mains supply is interrupted.

A further advantage of the traditional cold water supply system described above is that the hot water system is also fed with cold water from the same cold water tank and so the water pressure available at the hot and cold faucets at one basin or bath is essentially the same.

A very significant problem with the traditional system described above is that the tank in the roof space rarely is serviced or cleaned out. The consequence is that various moulds, or other bacterial matter may contaminate the water in the tank, leading to a risk of disease. In many countries, regulations are being introduced for buildings to which the public has access, which regulations specify frequent emptying and cleansing of the tank, in order to reduce the likelihood of foreign organisms contaminating the cold water.

In the case of a multi-storey building, the mains water supply pressure may be insufficiently high to supply the upper storeys of the building. In such a case, it is usual to install a storage tank (usually referred to as a break tank) at the ground floor level and employ a local electrically-driven pump set to pump water either to a roof storage tank or directly to the faucets throughout the building, including on the upper storeys. The pump must be capable of meeting the instantaneous demand from the faucets in the building and so must have a relatively large maximum rate of pumping. As a consequence, the pump set arrangement must have a relatively high electrical power requirement. For example, a pump set for even quite small buildings may be rated at 5 hp or more.

An alternative cold water supply system, as widely used in Continental Europe, is to connect all of the cold water faucets in a building directly to the incoming mains supply pipe, and so wholly to obviate the use of a cold water storage tank. The disadvantage of this is that the flow rate available at any given faucet is limited to the maximum possible flow rate through the incoming supply pipe. In the event that more than one faucet is turned on, the maximum flow rate is divided between the opened faucets. As a consequence, the incoming mains water supply pipe usually must be of a significantly greater diameter to accommodate the maximum likely demand flow rate, as compared to a system employing a storage tank in the roof space of the building. This greatly increases the installation cost.

A further problem with a mains pressure supply system is that the hot water system must also operate at mains water pressure and this means special measures must be taken to accommodate the expansion of the water in the hot water system as the temperature of the water is raised, and so to prevent the pressure building excessively in the hot water system. Also, measures must be taken to prevent water being driven back down the incoming cold water supply pipe.

It will be appreciated that with a mains pressure cold water supply system as described above when fitted to a multi-storey building, the pressure available at faucets on upper floors will be less than the pressure available on lower floors. Thus, the pressure available at a bath (which usually has the highest flow rate demand in a domestic dwelling) may be unacceptably low, particularly if the bath is installed on the top floor of a building having more than two floors.

SUMMARY OF THE INVENTION

The present invention aims at addressing the problems associated with the supply of cold water to all of the floors of a multi-storey building, when employing a mains water pressure supply system without the use of a roof space storage tank.

Accordingly, one aspect of this invention, provides a cold water supply system for a multi-storey building having lower and upper floors and there being an external mains water supply for the building, which system comprises:

- a water inlet pipe leading into the building from said external mains water supply;
- a lower accumulator provided in the building on a lower floor thereof;
- an inlet non-return valve arranged adjacent the lower accumulator and said inlet pipe being connected to the lower accumulator through said non-return valve;
- an upper accumulator provided on an upper floor of the building;
- a riser leading from the lower accumulator to the upper accumulator;
- a lower non-return valve and an upper non-return valve disposed in said riser respectively adjacent the outlet from the lower accumulator and adjacent the inlet to the upper accumulator;
- a water distribution pipe connected to the upper accumulator for supplying cold water to at least the upper floor of the building; and
- an electrically-driven pump having a water inlet and a water outlet and arranged in the riser to pump water to the upper accumulator.

According to a second aspect of this invention, there is provided a method of supplying cold water to a multi-storey building having lower and upper floors, which method comprises:

- supplying water through a water inlet pipe leading into the building from a mains water supply external of the building;
- supplying the water from the inlet pipe though an inlet non-return valve to a lower accumulator provided in the building on a lower floor thereof, the inlet non-return valve being arranged adjacent the lower accumulator;

pumping water from the lower accumulator with an electrically-operated pump into a riser leading from the lower accumulator to an upper accumulator provided on an upper floor of the building, there being respective lower and upper non-return valves disposed in the riser adjacent the outlet from the lower accumulator and the inlet to the upper accumulator; and supplying cold water from the upper accumulator to a water distribution pipe to distribute cold water to at least the upper floor of the building.

It is of course known to buffer pressure variations in water supply systems by using an accumulator. Though there are various designs of accumulator, a common type used in water supply systems has a pressure vessel with a resilient diaphragm dividing the vessel into two chambers. An inlet pipe communicates with one chamber and the other chamber is wholly sealed from both the first chamber and the atmosphere. The supply of water under pressure to said one chamber deforms the diaphragm and so compresses air in the other chamber. In this way, the accumulator may accept water or discharge water, dependent upon the relative pressures within the one chamber and in the pipe connected to that chamber, so smoothing variations in supply pressure.

BRIEF DESCRIPTION OF THE DRAWINGS

In order that the invention may better be understood, one specific embodiment of cold water supply system arranged in accordance with the present invention will be described in detail in the following, with reference to the accompanying drawing which shows a typical installation of the invention in a three-storey building.

DESCRIPTION OF THE PREFERRED EMBODIMENTS

In its broadest aspects, the present invention contemplates the use of two accumulators in the cold water supply system, with one accumulator on the lower floor and one accumulator on the top floor of the building. The accumulators should have a relatively large volume, so as to be capable of satisfying an expected demand—such as to fill a bath, when augmented by flow up the riser. Each such accumulator may comprise two or more accumulators in parallel, so as to obtain a sufficient accumulated volume for the intended installation. In the following, references will be made solely to single accumulators, but it is to be understood that each such single accumulator may comprise a plurality of accumulators, effectively in parallel, to obtain the required capacity.

The pump serves to pump water up the riser to the upper accumulator, such that there will be a sufficient capacity on the upper floors of the building to meet an expected demand for water, on the or each floor served by the distribution pipe connected to the upper accumulator. The selected pump used in the riser may be an in-line booster pump, preferably installed in the vicinity of the lower accumulator and able to deliver static pressure when there is no flow demand and also able to deliver flow when there is demand from the upper accumulator or from faucets connected to the upper distribution pipe. By providing such a pump, and ignoring pressure losses through the pipe work, the non-return valves and so on, it is possible for the pressure available on the upper floors to be essentially the same as that on the lower floors of the building.

The non-return valves prevent water flowing back from the upper accumulator to a lower floor and so ensure that the maximum available flow rate can be achieved on an upper floor, supplemented by the operation of the pump, even if a faucet has been opened on a lower floor.

Though the invention could be used with a building having only two floors, it is anticipated that this would be done only when the incoming water mains has a very low pressure. Normally, the invention would be used with a building having three or more floors. In the case of a building having several floors, it would be possible to install a further accumulator on one or more intermediate floors, for supplying water to that intermediate floor and perhaps some intervening floors as well. Further, in the case of high-rise buildings, one or more additional pumps may be provided in the riser, in the vicinity of the or each further accumulator. If further pumps are installed as aforesaid along with associated accumulators, then non-return valves should be fitted into the riser to prevent back-flow from the pump, to floors below the pump.

The operating characteristics of the pump should be selected dependent upon the particular circumstances of the intended installation. Account must be taken of matters such as the maximum flow rate and available pressure at the incoming mains supply, the capacity of the accumulators of the cold water system, the number of floors which are to be served by the system, and the expected average demand which is likely to be placed on the system by the floors supplied with water from the upper accumulator.

Taking the foregoing into account, for a small block of faucets having three floors, a typical pump may have a maximum volumetric throughput of the order of 50 to 100 liters per minute, under low head conditions. An alternative way of looking at the capacity of the pump might be by considering the capacity of the accumulators. In this case, the volumetric throughput per minute might be in the range of 10% to 50% of the capacity of the lower accumulator, for a situation where the pump is required to operate with only a small head.

Further, the pump must be capable of generating a static pressure, with essentially no, or only very small, flow rates. Typically, under such conditions the pump may be capable of generating a static pressure of the order of 2 to 3 bar. Then, the total pressure available at the outlet from the pump, and so at the bottom of the riser, would be equal to the achievable static pressure of the pump plus the pressure of the incoming mains, but less the losses in the system. At the point at which there is no flow to the upper accumulator, a pressure will be achieved at the upper accumulator equal to that at the bottom of the riser less the head of water thereabove.

In an attempt significantly to reduce the electrical power demand of the system when used to supply cold water to a multi-storey building, particularly as compared to a system employing a break tank and pump set, it is envisaged that solar power may be employed to supply electricity to the pump. Current designs of solar panels can produce electricity even in relatively dull conditions and so the pump may operate essentially continuously during the hours of daylight. Further, by positioning the solar panel so as to be capable of collecting light from an artificially lit area, the panel may still produce enough electricity to drive the pumps during the hours of darkness. For example, a multi-storey building to which the cold water distribution system of this invention might be fitted may have a car park associated with it, which park is artificially lit throughout the hours of darkness. By appropriate positioning of the solar collector panel, 24 hour operation of the pump may be achieved.

The embodiment of cold water supply system shown in the drawing will now be described in detail. This system is intended for a multi-storey building, for example arranged as a three-storey block of apartments, with two separate apartments on each of the ground floor 10, an intermediate floor 10A and on the top floor 11. Each apartment has a bathroom, kitchen and shower, which must be supplied with cold water. The standing mains water supply pressure may typically be approximately 2 to 3 bar.

The water flows are shown in the drawing by arrows alongside the various pipes, as will be discussed below. Water enters the building at ground floor level through an incoming mains water supply pipe 12 fitted with a stop-cock 13 and downstream of which are two non-return valves 14, arranged in series, to prevent water flow from the building back into the supply pipe 12. The incoming supply pipe typically would be of at least 22 mm diameter, but probably greater for a building of this kind.

The downstream side of the non-return valves 14 connect to a drain cock 15 and also to an accumulator 16, typically having a capacity of 500 liters. Though only a single accumulator is shown, this accumulator may consist of a plurality of similar accumulators, all connected to the downstream side of the non-return valves 14, effectively in parallel.

The accumulator 16 comprises a pressure vessel with an internal elastomeric impervious diaphragm 17 dividing the interior of the vessel into two chambers. The upper chamber is sealed from the external atmosphere, and the lower chamber is connected to pipe 18. Water supplied under pressure to the lower chamber will compress the air in the upper chamber by deformation of the diaphragm 17, until the air pressure in the upper chamber is equal to the water pressure in the lower chamber, ignoring the force needed to deform the diaphragm.

The pipe 18 from the accumulator 16 also connects to two further non-return valves 19, again arranged in series and the outlet side of which connects to an electrically-driven pump 21. The pressure side of the pump connects through pipe 22 to a riser 23 extending to the top floor 11 of the building. At the foot of the riser, there is provided a further drain cock 24.

At the top floor, two further non-return valves 26 are provided in series in the riser and downstream of those valves there is provided an upper accumulator 27. This accumulator is of the same design and capacity as that of the lower accumulator 16. Again, the upper accumulator may comprise a plurality of similar accumulators effectively in parallel and all connected to the downstream side of the non-return valves 26. From here, a cold water distribution pipe 28 serves to supply cold water to faucets on the top floor of the building but also to the intermediate floor, as appropriate.

As will be appreciated, and ignoring pressure losses through the non-return valves, the available pressure at the top floor 11 during no-flow conditions will be equal to the incoming water pressure plus the static pressure of the pump 21 less the head of water above the pump. Thus, despite the height of the upper accumulator 27 above the ground floor 10, the pressure at the upper accumulator should still be sufficient to supply water to faucets on the top floor as well as on the intermediate floor. During periods of demand, that will be met by outflow from the upper accumulator supplemented by flow up the riser, delivered by the throughput of the pump 21. In this way, adequate flow rates for the top floor 11 may be achieved. Rapid recharging of the accumulator 27 will be achieved after the demand ceases, until there is a uniform pressure throughout the system, differing from the ground floor 10 to the top floor 11 by virtue of the head of water above the ground floor.

Though not shown in the drawings, a suitable power supply for the pump 21 must be provided. For the installation described above, the pump typically may have a 500 W electric motor, which of course is very significantly less than the motor which is required to drive a pump set of a break tank system as described hereinbefore.

The pump may be driven by mains electricity, or by a low-voltage supply, powered by the mains electricity. Another possibility is to have a low-voltage pump supplied with power from a solar panel collecting light. In this case, as mentioned hereinbefore, the solar panel may be disposed so as to collect sunlight during the daytime, and to collect artificial light from, for example, floodlighting, during the hours of darkness. In this way, 24 hour operation of the pump may be achieved, without drawing any electrical power from the mains supply.

I claim:

1. A method of supplying cold water to a multi-storey building having lower and upper floors, which method comprises:

supplying water through a water inlet pipe leading into the building from a mains water supply external of the building;

supplying the water from the inlet pipe though an inlet non-return valve to a lower accumulator provided in the building on a lower floor thereof, the inlet non-return valve being arranged adjacent the lower accumulator;

pumping water from the lower accumulator with an electrically-operated pump into a riser leading from the lower accumulator to an upper accumulator provided on an upper floor of the building, there being respective lower and upper non-return valves disposed in the riser adjacent the outlet from the lower accumulator and the inlet to the upper accumulator; and supplying cold water from the upper accumulator to a water distribution pipe to distribute cold water to at least the upper floor of the building.

2. A cold water supply system for a multi-storey building having lower and upper floors and there being an external mains water supply for the building, which system comprises:

a water inlet pipe leading into the building from said external mains water supply;

a lower accumulator provided in the building on a lower floor thereof;

an inlet non-return valve arranged adjacent the lower accumulator and said inlet pipe being connected to the lower accumulator through said non-return valve;

an upper accumulator provided on an upper floor of the building;

a riser leading from the lower accumulator to the upper accumulator;

a lower non-return valve and an upper non-return valve disposed in said riser respectively adjacent the outlet from the lower accumulator and adjacent the inlet to the upper accumulator;

a water distribution pipe connected to the upper accumulator for supplying cold water to at least the upper floor of the building; and an electrically-driven pump having a water inlet and a water outlet and arranged in the riser to pump water to the upper accumulator.

3. A cold water supply system as claimed in claim 2, wherein said electrically-driven pump is arranged in the region of the lower floor of the building, adjacent the lower accumulator.

4. A cold water supply system as claimed in claim 2, wherein the inlet non-return valve comprises two non-return valves connected in series.

5. A cold water supply system as claimed in claim 2, wherein the first non-return valve comprises two non-return valves connected in series.

6. A cold water supply system as claimed in claim 2, wherein the upper non-return valve comprises two non-return valves connected in series.

7. A cold water supply system as claimed in claim 2, wherein the first accumulator has a single water connection which is connected into the system between said inlet and lower non-return valves.

8. A cold water supply system as claimed in claim 2, wherein the second accumulator has a single water connection which is connected into the system downstream of said upper non-return valve.

9. A cold water supply system as claimed in claim 2, wherein the water inlet of the pump is connected to the riser downstream of said lower non-return valve.

10. A cold water supply system as claimed in claim 9, wherein the pump is provided on the lower floor of the building and the water inlet of the pump is connected to the lower non-return valve immediately adjacent that valve, with the riser connected to the water outlet from the pump.

11. A cold water supply system as claimed in claim 2, wherein the capacity of the upper accumulator is not greater than the capacity of the lower accumulator.

12. A cold water supply system as claimed in claim 2, wherein the pump has a volumetric through-put of the order of 50 to 100 liters per minute.

13. A cold water supply system as claim in claim 2, wherein the pump has a volumetric through-put per minute in the range of 10% to 50% of the capacity of the lower accumulator.

14. A cold water supply system as claimed in claim 2, wherein the pump when operating generates a static pressure of the order of 2 to 3 bar.

15. A cold water supply system as claimed in claim 2, wherein the pump is a low-pressure centrifugal pump.

16. A cold water supply system as claimed in claim 2, wherein the pump is continuously driven.

17. A cold water supply system as claimed in claim 2, wherein a pressure-sensing switch is provided downstream of the upper non-return valve, and the pump is turned on whenever the sensed pressure falls below a pre-set level.

18. A cold water supply system as claimed in claim 2, wherein a solar panel is provided to supply the pump with electricity for running the pump.

19. A cold water supply system as claimed in claim 2 and for a building having more than two floors, wherein the water distribution pipe supplies cold water to the upper floor of the building and to floors intermediate the upper floor and the lower floor but not to the lower floor.

* * * * *